US005312461A

United States Patent [19]

Farng et al.

[11] Patent Number: 5,312,461

[45] Date of Patent: May 17, 1994

[54] DIHYDROCARBYL SUBSTITUTED PHENYLENEDIAMINE-DERIVED PHENOLIC PRODUCTS AS ANTIOXIDANTS

[75] Inventors: L. Oscar Farng, Lawrenceville; Andrew G. Horodysky, Cherry Hill, both of N.J.

[73] Assignee: Mobil Oil Corporation, Fairfax, Va.

[21] Appl. No.: 54,919

[22] Filed: Apr. 29, 1993

Related U.S. Application Data

[62] Division of Ser. No. 571,348, Aug. 23, 1990, Pat. No. 5,207,939.

[51] Int. Cl.[5] ..... C10L 1/22

[52] U.S. Cl. ..... 44/415; 44/428

[58] Field of Search ..... 44/415, 428

[56] References Cited

U.S. PATENT DOCUMENTS

| | | | |
|---|---|---|---|
| 3,368,972 | 2/1968 | Otto | 252/47.5 |
| 3,649,229 | 3/1972 | Otto | 44/73 |
| 3,994,698 | 11/1976 | Worrel | 44/415 |
| 4,025,316 | 5/1977 | Stover | 44/58 |
| 4,152,499 | 5/1979 | Boerzel et al. | 526/52.4 |
| 4,396,517 | 8/1983 | Gemmill, Jr. et al. | 252/51.5 |
| 4,787,996 | 11/1988 | Horodysky et al. | 252/51.5 |
| 4,803,004 | 2/1989 | Andress et al. | 252/51.5 |
| 4,806,130 | 2/1989 | Chibnik | 44/63 |
| 4,895,579 | 1/1990 | Andress et al. | 44/75 |
| 5,207,939 | 5/1993 | Farng et al. | 252/51.5 R |

*Primary Examiner*—Ellen M. McAvoy

*Attorney, Agent, or Firm*—Alexander J. McKillop; Malcolm D. Keen; Jessica M. Sinnott

[57] ABSTRACT

A lubricating oil, grease or fuel composition contains an antioxidant amount of a Mannich base reaction product of an N-hydrocarbyl-substituted-phenylenediamine or an N,N'-dihydrocarbyl-substituted phenylenediamine such as N,N'-di-sec-butyl-para-phenylenediamine, an aldehyde or ketone and a hindered phenol such as 2,6-di-tert-butylphenol.

18 Claims, No Drawings

DIHYDROCARBYL SUBSTITUTED PHENYLENEDIAMINE-DERIVED PHENOLIC PRODUCTS AS ANTIOXIDANTS

This is a division of copending application Ser. No. 07/571,348, filed on Aug. 23, 1990, now U.S. Pat. No. 5,207,939.

FIELD OF THE INVENTION

The invention relates to lubricants. More specifically, the invention relates to reaction products of a hydrocarbyl-substituted-phenylenediamine with a carbonyl compound and a di-hydrocarbyl-substituted phenol as antioxidant additives for lubricants.

BACKGROUND OF THE INVENTION

Lubricants undergo physical changes during operation due to oxidation of the lubricants. Typically, oxidation results from high temperatures, the presence of oxygen dissolved in the lubricant itself as well as mixing of the lubricant with oxygen supplied from the air. Among the problems associated with oxidation of lubricants are varnish formation on the pistons, ring sticking due to formation of carbon deposits and increased bearing corrosion due to formation of acids. Salt formation results from dissolved metals which together with oxidized lubricant form a sludge leading to increased viscosity of the lubricant. All of the foregoing can lead to increased fuel consumption and serious engine damage. Oxidation inhibitors have been developed to alleviate these problems.

Mannich base reaction products of mono-alkyl-substituted phenols, aldehydes and amines have been described as detergent-antiscuff additives in lubricants for 2-stroke gasoline engines in U.S. Pat. No. 4,025,316 to Stover and as detergent and antirust additives in hydrocarbon combustion fuels in U.S. Pat. No. 3,649,229 to Otto.

The Mannich base reaction products of alkenylsuccinic anhydrides, aryl-substituted monoamines and alcohols have been described as antioxidants in lubricants in U.S Pat. No. 4,803,004 to Andress et al.

SUMMARY OF THE INVENTION

It has now been found that the Mannich base reaction products of N-hydrocarbyl substituted-phenylenediamines or N,N'-dihydrocarbyl substituted-phenylenediamines with carbonyl compounds and di-hydrocarbyl substituted hindered phenols are effective antioxidant thermal stabilizing, antirust, anticorrosion and cleanliness additives for lubricating oils, greases and fuels.

DETAILED DESCRIPTION OF THE INVENTION

The lubricant additive of the present invention is a Mannich base reaction product of an N-hydrocarbyl substituted-phenylenediamine compound or an N,N- or N,N'-dihydrocarbyl-substituted-phenylenediamine compound with a carbonyl compound and a di-hydrocarbyl substituted phenol which has antioxidant properties in lubricants and fuels. The invention is also directed to a lubricating oil, grease composition or fuel composition comprising a major proportion of the lubricating oil, grease or fuel and a minor proportion of the reaction product and methods of making the same.

The phenylenediamines contemplated are mono- and di-substituted-para-phenylenediamines, mono- and di-substituted-meta-phenylenediamines and mono- and di-substituted-ortho-phenylenediamines. Specifically, the phenylenediamine compounds have the formula

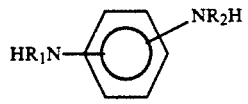

where $R_1$ and $R_2$ are the same or different aliphatic or aromatic hydrocarbyl containing 1 to 60 carbon atoms or oxygen, sulfur or nitrogen bonded to aliphatic or aromatic hydrocarbyl containing 2 to 60 carbon atoms. Either $R_1$ or $R_2$ can be a hydrogen atom but $R_1$ and $R_2$ cannot both be hydrogen atoms. Representative examples of such phenylenediamines include N,N'-dimethyl-p-phenylenediamine, N,N'-diethyl-p-phenylenediamine, N,N'-di-sec-butyl-p-phenylenediamine, N,N'bis(1-methyl-heptyl)-p-phenylenediamine, N,N'-di-sec-butyl-N,N'-dimethyl-p-phenylenediamine, N-phenyl-p-phenylenediamine, N,N'-diphenyl-p-phenylenediamine, N,N'-di-2-naphthyl-p-phenylenediamine, N-isopropyl-N'-phenyl-p-phenylenediamine, N-(1,3-dimethylbutyl)-N'-phenyl-p-phenylenediamine, and N-cyclohexyl-N'phenyl-p-phenylenediamine. The preferred phenylenediamines are N,N'-di-sec-butyl-p-phenylenediamine, sold by Uniroyal Chemical Company under the trade name NAUGALUBE 403 and N,N'-bis(1,4-dimethylpentyl)-p-phenylenediamine sold by Uniroyal Chemical Company under the trade name NAUGALUBE 443. Also contemplated are the tri- and tetra-substituted phenylenediamines such as the N,N,N'-tri-hydrocarbyl substituted-phenylenediamines and N,N,N',N'-tetra-hydrocarbyl substituted phenylenediamines in which the hydrocarbyl substituent is as indicated above.

The carbonyl compounds contemplated are aldehydes or ketones having the following structural formula:

$$R^3R^4C{=}0$$

where $R^3$ and $R^4$ are hydrogens or the same or different aliphatic or aromatic hydrocarbyls containing 1 to 60 carbons. $R^3$ and $R^4$ can also be oxygen, sulfur or nitrogen bonded to an aliphatic or aromatic hydrocarbyl group containing 2 to 60 carbons. Possible carbonyl compounds include formaldehyde, heptaldehyde, hexaldehyde, acetaldehyde, propionaldehyde, paraformaldehyde, benzaldehyde, salicylaldehyde, acetone, diethyl ketone and methyl ethyl ketone, the preferred carbonyl compound being 2-ethylhexanal.

The phenols which are used have the formula:

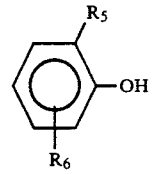

where $R_5$ and $R_6$ are the same or different aliphatic or aromatic hydrocarbyls of I to 60 carbon atoms or oxygen, sulfur or nitrogen bonded to aliphatic or aromatic hydrocarbyls of 2 to 60 carbon atoms. Steric hinderance of the phenol is an essential feature of the invention in order to obtain the desired antioxidant effect. Steric hinderance is a characteristic of the molecular structure of the phenol in which the hydrocarbyls are spatially arranged on the phenol such that reaction of the hydroxyl group with another molecule is prevented.

Representative examples of contemplated hindered phenols are 2,6-hydrocarbyl-substituted phenols such as 2,6-dimethylphenol, 2,6-diamylphenol, 2,6-dipropylphenol, 2,6-diphenylphenol, 2,6-diphenylethylphenol, 4,4'-methylene bis-(2,6-di-tert-butyl)phenol, the preferred phenol being 2,6-di-tert-butylphenol which is commercially available from the Ethyl Corporation under the tradename ETHANOX 701.

The hydrocarbyl substituted phenols of the present invention can be prepared from known methods by reacting 0.1 to 10 moles of phenol with I mole of an alpha olefin in the presence of a catalyst such as $BF_3$ (including the etherate, phenate or phosphate complexes), $BF_3$ or HCl gas with $AlCl_3$ at 80° C. to 250° C. The product is dissolved in an aromatic solvent and then washed with water to remove unreacted materials. After filtration and removal of the aromatic solvent by distillation the product, a clear, viscous oil, remains.

The phenylenediamine, the carbonyl compound and the phenolic compound combine in a condensation reaction to form the desired product. Water is formed during the condensation reaction: one mole of water is released for each mole of Mannich base condensation product formed so that the evolution of water can be utilized to monitor the course of the reaction. It is believed that the phenolic group has a radical chain terminating effect in the reaction. The compounds can be reacted in a molar excess of one compound over another since the reaction will proceed until one of the compounds is used up. However, the preferred proportions expressed as molar ratios of arylamine to carbonyl compound to phenol, respectively, are at least 0.1:0.1:1.0 to 1:2:2 and at most 10:10:1 to 1:10:10. The reaction is carried out at ambient pressure, the temperature can range from 40° C. to 200° C. preferrably from 50° C. to 120° C. The reaction time can range from 2 to 12 hours, the preferred range being from 6 to 8 hours. The reaction can be carried out in the presence of a diluent or solvent inert to the reactants such as an aromatic hydrocarbon. Appropriate solvents include toluene and xylenes. After completion of the reaction the reaction mass is treated, typically by filtration, to remove water or solvent remaining in solution. The resulting product is the desired additive.

Since the reactant molecules permit the condensation reaction to take place at several sites, a number of different product structures may be obtained. In general, the structure of the products may be represented by the formula:

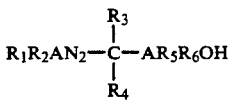

where $R_1$, $R_2$, $R_3$, $R_4$, $R_5$ and $R_6$ are the same or different, either $R_1$, $R_2$, $R_3$ or $R_4$ are hydrogen atoms (but $R_1$ and $R_2$ are not both hydrogen atoms) or are aliphatic or aromatic hydrocarbyls containing 1 to 60 carbon atoms or oxygen, sulfur or nitrogen bonded to aliphatic or aromatic hydrocarbyls containing 2 to 60 carbon atoms and A represents a phenyl group.

Specific types of structures which may be produced include:

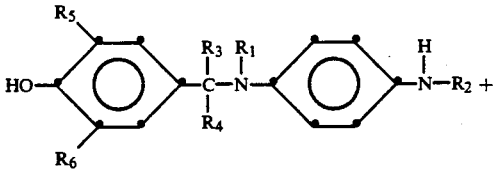

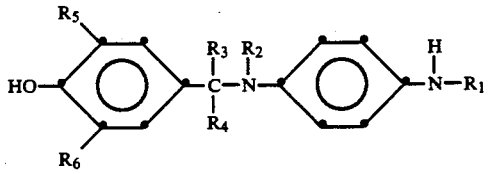

Other structures may be formed by condensation occurring directly on the nucleus of the diamine as in:

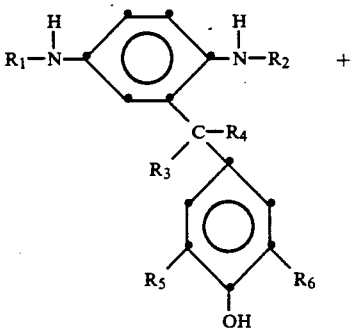

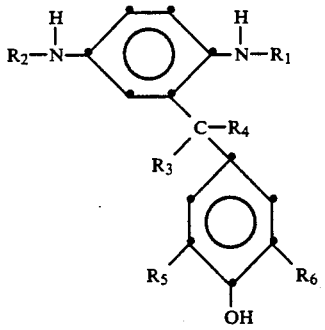

The reaction product is blended with lubricants in a concentration from about 0.01% to 10%, preferably from 0.05% to 5% by weight of the total composition.

An important feature of the invention is the ability of the additive to improve the oxidation resistance of the lubricant. It is believed that the antioxidant activity of the phenylenediamine group and the phenolic group is enhanced due to the alkyl linkage, derived from the carbonyl compound, which facilitates synergistic antioxidant activity between the phenylenediamine and the phenol.

Additionally, it is believed that the phenylenediamine component contributes significant metal deactivating and peroxide decomposing properties to the lubricant. The compositions also have potential high temperature stabilizing ability.

The additives are most effective in industrial applications, such as in circulation oils and steam turbine oils where large charges of oil are expected to last a lifetime of the machinery without being replaced. The antioxidant additives of the present invention are particularly necessary in this respect because throughout the serviceable life, the oil is exposed to oxidizing conditions such as circulating air, water and metal oxidation products resulting from the wear of metal surfaces.

Gas turbines, both heavy-duty gas turbines and aircraft gas turbines require multifunctional lubricant additives of the type described here. The temperature ranges, contamination and oxidation conditions to which the lubricant is exposed can be such that oil deterioration can be rapid.

The additives are also useful in diesel engine oils, i.e., those used in marine engines, locomotives, power plants and high speed automotive diesel engines. These additives are particularly useful in diesel engines because the engines do not combust as cleanly or completely as gasoline engines because oil degradation in service is a consequence of oxidative breakdown from blow-by gases containing high concentrations of oxides of nitrogen which promote oil oxidation and accelerate oil thickening. Additionally, metallic contaminants from the metals commonly present in these engines, such as copper, lead and iron catalyze oxidation.

Gasoline burning engines also benefit from the additives of the invention, although they are easier to lubricate than comparable diesel engines, because of cleaner combustion and less demanding operating conditions. However, since engine efficiency is ever-increasing, in order to conserve scarce resources, the need for multifunctional gas engine lubricant additives which improve resistance to corrosion, oxidation and wear predominates.

Automatic transmission fluids are another class of lubricants which benefit from the additives of the present invention. These fluids represent a careful balance of properties needed to meet the unique requirements of automatic transmissions. Improved oxidation stability, extra corrosion protection and antiwear properties are particularly important, and necessary, properties of these fluids. Hydraulic fluids in industrial equipment and air compressors have similar requirements and, thus, these additives are also beneficial in these fluids.

Machine tool lubricants such as mist oils, way lubricants, anticorrosion lubricants and quenching oils will also benefit from these additives.

Gear oils are another class of fluids which would benefit from the additives of the present invention. Typical of such oils are automotive spiral-bevel and worm-gear axle oils which operate under extreme pressures, load and temperature conditions which require antiwear additives. Additionally, hypoid gear oils operating under both high speed, low-torque and low-speed, high-torque conditions require lubricants that contain the multifunctional antiwear additives of the present invention. Since these in-service gear oils are in intimate contact with air, they are prone to oxidation which leads to decomposition and polymerization products.

It is also desirable to employ the additive in greases. Greases containing the additive are particularly useful in automobile chassis lubrication. Chassis lubricants need the multifunctional additives primarily because the machinery is exposed to many environments and extreme conditions, i.e., high and low temperatures, rain, mud, dust, snow and other conditions such as road salts and road conditions. The additives of the invention are necessary to provide improved rust protection, better oxidation and mechanical stability, reduced fretting and corrosion and improved load carrying capability.

Additionally, it is belived that the phenylenediamine component contributes significant metal deactivating and peroxide decomposing properties to the lubricant.

The contemplated lubricants are mineral oil, synthetic oils, mixtures thereof or greases in which any of the foregoing oils are employed as the vehicle.

In general, the mineral oils, both paraffinic and naphthenic and mixtures thereof can be employed as a lubricating oil or as the grease vehicle. The lubricating oils can be of any suitable lubricating viscosity range, for example, from about 45 SSU at 100° F. to about 6000 SSU at 100° F., and preferably from about 50 to 250 SSU at 210° F. The oils may have viscosity indexes ranging to 100 or higher. Viscosity indexes from about 70 to 95 being preferred. The average molecular weights of these oils can range from about 250 to about 800.

Where the lubricant is employed as a grease, the lubricant is generally used in an amount sufficient to balance the total grease composition, after accounting for the desired quantity of the thickening agent and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

Where synthetic oils, or synthetic oils employed as the vehicle for the grease, are desired in preference to mineral oils, or in mixtures of mineral and synthetic oils, various synthetic oils may be used. Typical synthetic oils include polyisobutylenes, polybutenes, hydrogenated polydecenes, polypropylene glycol and polyethylene glycol.

In general, the mineral oils, both paraffinic and naphthenic and mixtures thereof can be employed. The lubricating oils can be of any suitable lubricating viscosity range, for example, from about 45 SSU at 100° F. to about 6000 SSU at 100° F., and preferably from about 50 to 250 SSU at 210° F. The oils may have viscosity indexes ranging to 100 or higher. Viscosity indexes from about 70 to 95 being preferred. The average molecular weights of these oils can range from about 250 to about 800.

The lubricating oils and greases contemplated for blending with the reaction product can also contain other additive materials such as corrosion inhibitors, detergents, dispersants, extreme pressure agents, viscosity index improvers, demulsifiers, friction reducers, antiwear agents, and the like.

Typical additives of the kind include, but are not limited to, metallic sulfonates, metallic phenates, polymere succinimides and/or esters and/or amides, metallic or non-metallic phosphorodithioates, olefin copolymers, styrene-diene copolymers, methacrylates, sulfurized olefins, organic borates, and the like.

The additives are also useful in fuels. When the additives are utilized in fuels, the fuels contemplated are liquid hydrocarbon and liquid oxygenated fuels such as alcohols and ethers. The additives can be blended in a concentration from about 25 to about 500 pounds of additive per 1000 barrels of fuel. The liquid fuel can be a liquid hydrocarbon fuel or an oxygenated fuel or mixtures thereof.

Specifically, the fuel compositions contemplated include gasoline base stocks such as a mixture of hydrocarbons boiling in the gasoline boiling range which is from about 90° F. to about 450° F. This base fuel may consist of straight or branched chain paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons and catalytically cracked reformed stock. The composition and octane level of the base fuel is not critical and any conventional motor fuel base can be employed in the practice of this invention. Further examples of fuels of the type are petroleum distillate fuels having an initial boiling point ranging from about 75° F. to about 135° F. and an end boiling point ranging from about 250° F. to about 750° F. It should be noted in this respect that the term distillate fuels is not intended to be restricted to straight-run distillate fractions. These distillate fuel oils can be straight-run distillate fuel oils catalytically or thermally cracked (including hydrocracked) distillate fuel oils etc. Moreover, such fuel oils can be treated in accordance with well-known commercial methods, such as acid or caustic treatment, dehydrogenation, solvent refining, clay treatment, and the like.

Particularly contemplated among the fuel oils are Nos. 1, 2 and 3 fuel oils used in heating and as Diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing little or no hydrocarbon. As stated above, typical of such fuels are methanol, ethanol and mixtures of methanol and ethanol. The fuels which may be treated with the additive include gasohols which may be formed by mixing 90 to 95 volumes of gasoline with 5 to 10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, the fuel compositions of the instant invention may additionally contain conventional carburetor detergents, anti-knock compounds, anti-icing additives, upper cylinder and fuel pump lubricity additives and the like.

A particular advantage of the invention is the solubility of the additive in base lubricating oils. The substituted phenylenediamine (particularly the di-substituted phenylenediamine) derived Mannich adducts of the present invention have improved solubility and compatability in lubricants. Hence, the hydrocarbyl substituents of the phenylenediamine were essential aspects of the invention because the hydrocarbyl substituted-phenylenediamine was critical to the additive's solubility and stability in lubricants.

EXAMPLE 1

Approximately 88g (0.4 mole) N,N'-di-sec-butyl-para-phenylenediamine (commercially available from Uniroyal Chemical Company under the trade name Naugalube 403), and 82.4 g (0.4 mole) commercial 2,6-di-tert-butylphenol (Ethyl Corporation under the trade name Ethanox 701) were charged in a reactor equipped with heater, agitator, and Dean-Stark tube with condenser. The reactants were heated at 50° C., and slowly, 51.3 g (0.4 mole) of 2-ethylhexanal was added over a period of an hour. Thereafter, this mixture was heated at 100° C. for one hour, at 120° C. for another five hours during which time volatiles were collected in the Dean-Stark trap. Finally, the solution was filtered through diatomaceous earth to produce a dark fluid as desired product.

EXAMPLE 2

Approximately 122.4 g (0.4 mole) N,N'-bis(1,4-dimethylpentyl) para-phenylenediamine (Naugalube 443 obtained from Uniroyal Chemical Company) and 82.4 g (0.4 mole) 2,6-di-tert-butylphenol were mixed in a four-neck flask. Slowly 51.3 g of 2-ethylhexanal (0.4 mole) was added dropwise from a dropping funnel at 55° C. over a period of one hour. Thereafter, the reactants were heated at 100° C. for an hour, and at 120° C. for five hours. The volatiles were removed by vacuum distillation and the product was filtered through diatomaceous earth.

The following data, reported in the Tables, illustrated the improved antioxidant characteristics of the present invention. The products of Examples 1 and 2 were tested for antioxidant properties at a 1% concentration in a neutral base stock oil. The products were also compared to other known antioxidants which were blended in a 1% concentration in the same base stock.

Tables I and II present the test results of the products of Examples 1 and 2, which were blended into a mineral oil sample and evaluated for oxidative stability, in the Catalytic Oxidation Test. In the Catalytic Oxidation Test, the tests were run at 325° F. for 40 hours (Table I) and at 325° F. for 72 hours (Table II). The test procedure consisted of subjecting a volume of the test lubricant to a stream of air which was bubbled through the test composition at a rate of five liters per hour for the specified number of hours and at the specified temperature. Present in the test composition were metals commonly used as materials to construct engines, namely:

1) 15.5 square inches of a sand-blasted iron wire;
2) 0.78 square inches of a polished copper wire;
3) 0.87 square inches of a polished aluminum wire; and
4) 0.107 square inches of a polished lead surface.

The results of the Catalytic Oxidation Test using the additives of the present invention and other known additives were reported below in Tables I and II. The results of the test were presented in terms of change in kinematic viscosity (kV), change in neutralization number (TAN), lead loss and sludge formation. Essentially, the small change in kV meant that the lubricant maintained its internal resistance to oxidative degradation even under high temperatures, the small change in TAN indicated that the oil maintained its acidity level under oxidizing conditions and the small change in lead loss indicated that the lubricant was not corrosive to lead under seriously corrosive conditions such as high temperatures and oxidizing conditions.

The products of Examples 1 and 2 were also tested for their ability to resist corrosion of copper in the Copper Strip Corrosivity Test. The test consisted of immersing a polished copper strip in a given quantity of a sample of the test composition. The sample was heated to 250° F. At the end of approximately 3 hours the copper strip was removed, washed and compared with the ASTM Copper Strip Corrosion Standards. The Corrosion Standards consisted of color reproductions of typical test strips representing increasing degrees of tarnish and corrosion. The degree of corrosivity was reported in accordance with four specific classifications which ranged from 1, the highest score represented slight tarnish, to 4, the lowest score which represented actual corrosion. It will be noted that the composition of the present invention achieved a "1A" rating which was the same as the rating achieved by the base oil alone. This rating indicated that the products of the examples were not corrosive to copper. The results of the test were reported in Table III.

TABLE 1

| | Catalytic Oxidation Test 40 Hours at 325° F. | | | | |
|---|---|---|---|---|---|
| Item | Additive Conc. (wt %) | Change In Acid Number Delta TAN | Percent Change In Viscosity % Delta KV | Lead Loss | Sludge |
| Base Oil (200 second solvent refined, paraffinic neutral, mineral oil) | — | 4.78 | 57.9 | 2.9 | Heavy |
| Example 1 | 1.0 | 2.16 | 14.8 | 0.0 | Heavy |
| Example 2 | 1.0 | 1.98 | 30.4 | 2.6 | Heavy |
| 2,6-di-tert butylphenol | 1.0 | 6.35 | 78.4 | 0.0 | Heavy |
| Phenolic Antioxidant (Irganox L-130) | 1.0 | 5.31 | 45.1 | 0.0 | Heavy |
| 4,4'-Methylene bis (2,6-di-t-butyl) phenol | 1.0 | 6.24 | 62.4 | 0.0 | Heavy |

TABLE 2

| | Catalytic Oxidation Test 72 Hours at 325° F. | | | | |
|---|---|---|---|---|---|
| Item | Additive Conc. (wt %) | Change In Acid Number Delta TAN | Percent Change In Viscosity % Delta KV | Lead Loss | Sludge |
| Base Oil (200 second solvent refined, paraffinic neutral, mineral oil) | — | 8.53 | 99.4 | 5.2 | Heavy |
| Example 1 | 1.0 | 3.42 | 42.6 | 1.0 | Heavy |
| Example 2 | 1.0 | 3.06 | 36.7 | 2.3 | Heavy |
| Phenolic Antioxidant (Irganox L-130) | 1.0 | 6.48 | 58.1 | 0.0 | Heavy |
| 4,4'-Methylene bis (2,6-di-t-butyl) phenol | 1.0 | 7.13 | 101.3 | 0.0 | Heavy |
| Arylamine Antioxidant (Irganox L-57) | 1.0 | 6.14 | 79.1 | 0.0 | Heavy |
| 2,6-di-tert-butylphenol | 1.0 | 8.17 | 143.3 | 0.0 | Heavy |

TABLE 3

| | (D130) Copper Strip Corrosivity Test 3 Hours at 250° F. | |
|---|---|---|
| Item | Additive conc. (wt %) | Corrosivity Rating |
| Base Oil (200 second, solvent refined, paraffinic, neutral, mineral oil) | — | 1A |
| Example 1 | 1.0 | 1A |
| Example 2 | 1.0 | 1A |

What is claimed is:

1. A fuel composition comprising a fuel and an antioxidant amount of a reaction product of a hydrocarbyl-substituted phenylenediamine, in which the hydrocarbyl substituents contain from 4 to 60 carbon atoms, a carbonyl compound and a di-hydrocarbyl-substituted hindered phenol whereby the reaction product has improved fuel solubility properties.

2. The composition of claim 1 in which the hydrocarbyl-substituted phenylenediamine is selected from the group consisting of a di-hydrocarbyl-substituted para-phenylenediamine, di-hydrocarbyl-substituted ortho-phenylenediamine, and di-hydrocarbyl-substituted-metaphenylenediamine.

3. The composition of claim 1 in which the phenylenediamine is selected from the group consisting of N,N'-di-sec-butyl-p-phenylenediamine, and N,N'-bis (1,4-dimethylpentyl)-para-phenylenediamine.

4. The composition of claim 1 in which the carbonyl compound is an aldehyde or ketone of the formula:

$$R^3R^4\,C{=}0$$

in which $R^4$ and $R^4$ are hydrogen atoms or hydrocarbyl containing 1 to 60 carbon atoms, oxygen bonded to hydrocarbyl containing 2 to 60 carbon atoms, sulfur bonded to hydrocarbyl containing 2 to 60 carbon atoms or nitrogen bonded to hydrocarbyl containing 2 to 60 carbon atoms.

5. The composition of claim 1 in which the carbonyl compound is selected from the group consisting of 2-ethylhexanal, acetone, diethyl ketone, methyl ethyl ketone, formaldehyde, heptaldehyde, hexaldehyde, paraformaldehyde, propionaldehyde, acetaldehyde, benzaldehyde or salicylaldehyde.

6. The composition of claim 1 in which the hydrocarbyl of the hindered phenol contains 1 to 60 carbon atoms, oxygen bonded to hydrocarbyl containing 2 to 60 carbon atoms, sulfur bonded to hydrocarbyl containing 2 to 60 carbon atoms or nitrogen bonded to hydrocarbyl containing 2 to 60 carbon atoms.

7. The composition of claim 1 in which the hindered phenol is a 2,6-hydrocarbyl-substituted phenol selected from the group consisting of 2,6-di-tert-butyl-phenol, 2,6-dimethylphenol, 2,6-diamylphenol, 2,6-dipropylphenol, 2,6-phenylphenol, 2,6-diphenylethylphenol, or 4,4'-methylene-bis-(2,6-di-tert-butyl)phenol.

8. The composition of claim 1 in which the fuel is a liquid hydrocarbon fuel liquid oxygented fuel or mixture thereof which contains 0.0001 to 0.1 wt % of the reaction product.

9. A fuel composition comprising a major amount of a fuel and an amount sufficient to impart antioxidant and anticorrosion properties to the fuel of a reaction product of a phenylenediamine which is selected from the group consisting of N,N'-di-sec-butyl-p-phenylenediamine and N,N'-bis(1,4-dimethylpentyl)-p-phenylenediamine, a carbonyl compound having the following structural formula:

$$R_3R_4C{=}o$$

where $R_3$ and $R_4$ are the same or different, hydrogen atom, hydrocarbyl containing 1 to 60 carbon atoms or at least one heteroatom such as oxygen, sulfur or nitrogen and a dihydrocarbyl-substituted hindered phenol compound whereby the reaction product has improved fuel solubility properties.

10. The composition of claim 9 in which the carbonyl compound is selected from the group consisting of formaldehyde, acetaldehyde, propionaldehyde, paraformaldehyde, benzaldehyde, salicylaldehyde, hexaldehyde, heptaldehyde, acetone, diethyl ketone and methyl ethyl ketone.

11. The composition of claim 9 in which the dihydrocarbyl-substituted hindered phenol is a 2,6-hydrocarbyl-substituted phenol selected from the group consisting of 2,6-di-tert-butyl phenol, 2,6-dimethylphenol, 2,6-diamylphenol, 2,6-dipropylphenol, 2,6-diphenylphenol, 2,6-diphenylethylphenol and 4,4'-methylene-bis-(2,6-di-tert-butyl)phenol.

12. A method of making a fuel composition comprising combining a major amount of a fuel and a minor additive amount of a reaction product having antioxidant properties comprising a reaction product of a hydrocarbyl-substituted phenylenediamine compound in which the hydrocarbyl substituent contains 4 to 60 carbon atoms, a carbonyl compound and a di-hydrocarbyl-substituted hindered phenol whereby the reaction product has improved fuel solubility properties.

13. The method of claim 12 in which the phenylenediamine is a di-hydrocarbyl-substituted para-phenylenediamine, di-hydrocarbyl-substituted ortho-phenylenediamine or di-hydrocarbyl-substituted meta-phenylenediamine.

14. The method of claim 12 in which the phenylenediamine is selected from the group consisting of N,N'-di-sec-butyl-p-phenylenediamine and N,N'-bis(1,4-dimethylpentyl)-para-phenylenediamine.

15. The method of claim 12 in which the carbonyl compound is an aldehyde or ketone of the formula:

$$R_3R_4C{=}0$$

in which $R_3$ and $R_4$ are the same or different hydrocarbyl containing 1 to 60 carbon atoms, oxygen bonded to hydrocarbyl containing 2 to 60 carbon atoms, sulfur bonded to hydrocarbyl containing 2 to 60 carbon atoms or nitrogen bonded to hydrocarbyl containing 2 to 60 carbon atoms.

16. The method of claim 12 in which the carbonyl compound is 2-ethylhexanal, acetone, diethyl ketone, methyl ethyl ketone, formaldehyde, heptaldehyde, hexaldehyde, paraformaldehyde, propionaldehyde, acetaldehyde, benzaldehyde, or salicylaldehyde.

17. The method of claim 12 in which the hydrocarbyl of the hindered phenol contains 1 to 60 carbon atoms, oxygen bonded to hydrocarbyl containing 2 to 60 carbon atoms, sulfur bonded to hydrocarbyl containing 2 to 60 carbon atoms or nitrogen bonded to hydrocarbyl containing 2 to 60 carbon atoms.

18. The method of claim 12 in which the hindered phenol is a 2,6-hydrocarbyl-substituted phenols such as 2,6-ti-tert-butylphenol, 2,6-dimethylphenol, 2,6diamylphenol, 2,6-dipropylphenol, 2,6-dibenzylphenol, 2,6-diphenylphenol, 2,6-diphenylethylphenol, or 4,4'-methylene-bis-(2,6-di-tert-butyl)phenol.

* * * * *